US006053174A

United States Patent [19]

De Koker et al.

[11] Patent Number: 6,053,174

[45] Date of Patent: Apr. 25, 2000

[54] METHOD AND APPARATUS FOR THE ENHANCEMENT OF TOBACCO

[75] Inventors: Kobus De Koker, Paarl; Johan Bakkes, Stellenberg, both of South Africa

[73] Assignee: Tobacco Research and Development Institute Limited, Vaduz, Liechtenstein

[21] Appl. No.: 09/147,918

[22] PCT Filed: Sep. 23, 1997

[86] PCT No.: PCT/EP97/05240

§ 371 Date: Jun. 28, 1999

§ 102(e) Date: Jun. 28, 1999

[87] PCT Pub. No.: WO98/14077

PCT Pub. Date: Apr. 9, 1998

[30] Foreign Application Priority Data

Sep. 23, 1996 [ZA] South Africa ..... 96/8026

[51] Int. Cl.[7] ..... A24B 3/18

[52] U.S. Cl. ..... 131/296; 131/291; 131/302; 131/304; 131/306; 131/901; 131/108; 131/109.3; 99/323.4; 99/323.8; 99/323.9

[58] Field of Search ..... 131/108, 109.3, 131/290, 291, 296, 302, 304, 306, 901; 99/323.4, 323.8, 323.9

[56] References Cited

U.S. PATENT DOCUMENTS 4,878,422 11/1989 McCullough et al. .

4,967,769 11/1990 Franklin et al. .

FOREIGN PATENT DOCUMENTS 2 401 625 3/1979 France .
2 138 666 10/1984 United Kingdom .
2 203 929 11/1988 United Kingdom .
90 03124 4/1990 WIPO .

*Primary Examiner*—Stanley S. Silverman
*Assistant Examiner*—Michael P. Colaianni
*Attorney, Agent, or Firm*—Alston & Bird LLP

[57] ABSTRACT

A tobacco enhancement apparatus and a method of enhancing tobacco using the apparatus comprising a tunnel (12) having a vibratory conveyor floor (18), and an inlet (14) for receiving unexpanded tobacco shreds. A steaming and swirling station (32) is located downstream of the inlet and comprises an array of overhead steam nozzles arranged above the floor for steaming and expanding the shreds. The steam nozzles are positioned and angled to create vortices amongst the shreds. A conditioning venturi station (50) is located downstream of the steaming station for prolonging the exposure of the expanded tobacco shreds to conditions of increased vapor pressure. A set point controller (198) is provided for automatically monitoring and adjusting the downward angle of the steam nozzles, the steam pressure, the height of the nozzles, the height of the venturi station and the temperature of the expanded tobacco.

16 Claims, 15 Drawing Sheets

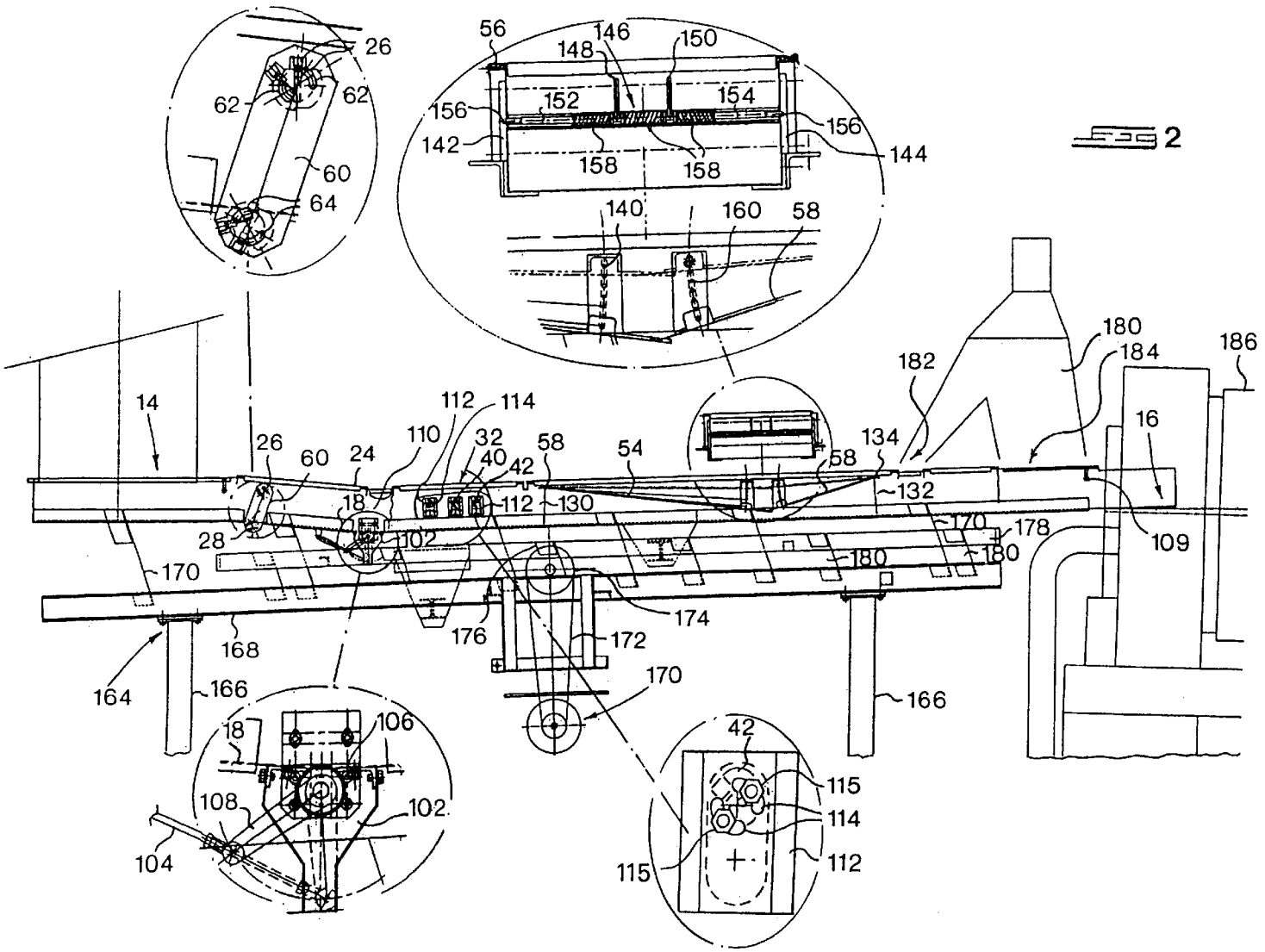
2
186
184
180
16
109
178
180
170
182
132
134
166
144
156
58
160
154
150
158
146
148
152
140
56
142
54
174
172
170
130
112
42
40
32
114
176
110
102
24
18
60
26
28
168
166
14
164
62
64
106
108
104
115

FROM FIG 6
FROM FIG 6
4-20mA
4-20mA
4-20mA
4-20mA
FROM FIG 6A
PLC CONTROL
198

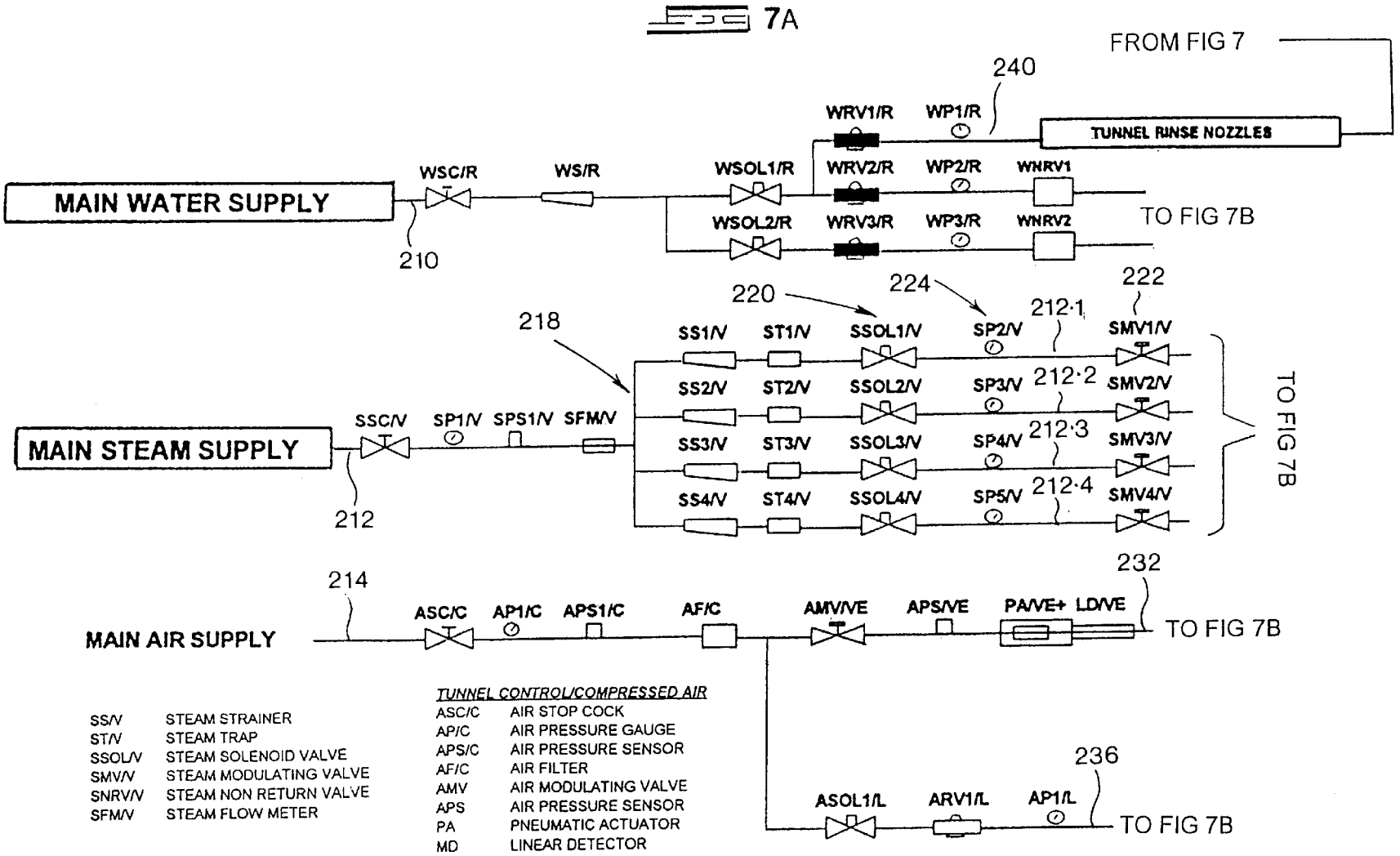
FIG 7A
FROM FIG 7
TUNNEL RINSE NOZZLES
TO FIG 7B
TO FIG 7B
TO FIG 7B
TO FIG 7B
240
WP1/R
WP2/R
WP3/R
WNRV1
WNRV2
WRV1/R
WRV2/R
WRV3/R
WSOL1/R
WSOL2/R
WS/R
WSC/R
210
MAIN WATER SUPPLY
222
SMV1/V
SMV2/V
SMV3/V
SMV4/V
212·1
212·2
212·3
212·4
224
SP2/V
SP3/V
SP4/V
SP5/V
SSOL1/V
SSOL2/V
SSOL3/V
SSOL4/V
220
ST1/V
ST2/V
ST3/V
ST4/V
SS1/V
SS2/V
SS3/V
SS4/V
218
SFM/V
SPS1/V
SP1/V
SSC/V
212
MAIN STEAM SUPPLY
232
PA/VE+ LD/VE
APS/VE
AMV/VE
AF/C
APS1/C
AP1/C
ASC/C
214
MAIN AIR SUPPLY
236
AP1/L
ARV1/L
ASOL1/L
SS/V STEAM STRAINER
ST/V STEAM TRAP
SSOL/V STEAM SOLENOID VALVE
SMV/V STEAM MODULATING VALVE
SNRV/V STEAM NON RETURN VALVE
SFM/V STEAM FLOW METER
TUNNEL CONTROL/COMPRESSED AIR
ASC/C AIR STOP COCK
AP/C AIR PRESSURE GAUGE
APS/C AIR PRESSURE SENSOR
AF/C AIR FILTER
AMV AIR MODULATING VALVE
APS AIR PRESSURE SENSOR
PA PNEUMATIC ACTUATOR
MD LINEAR DETECTOR

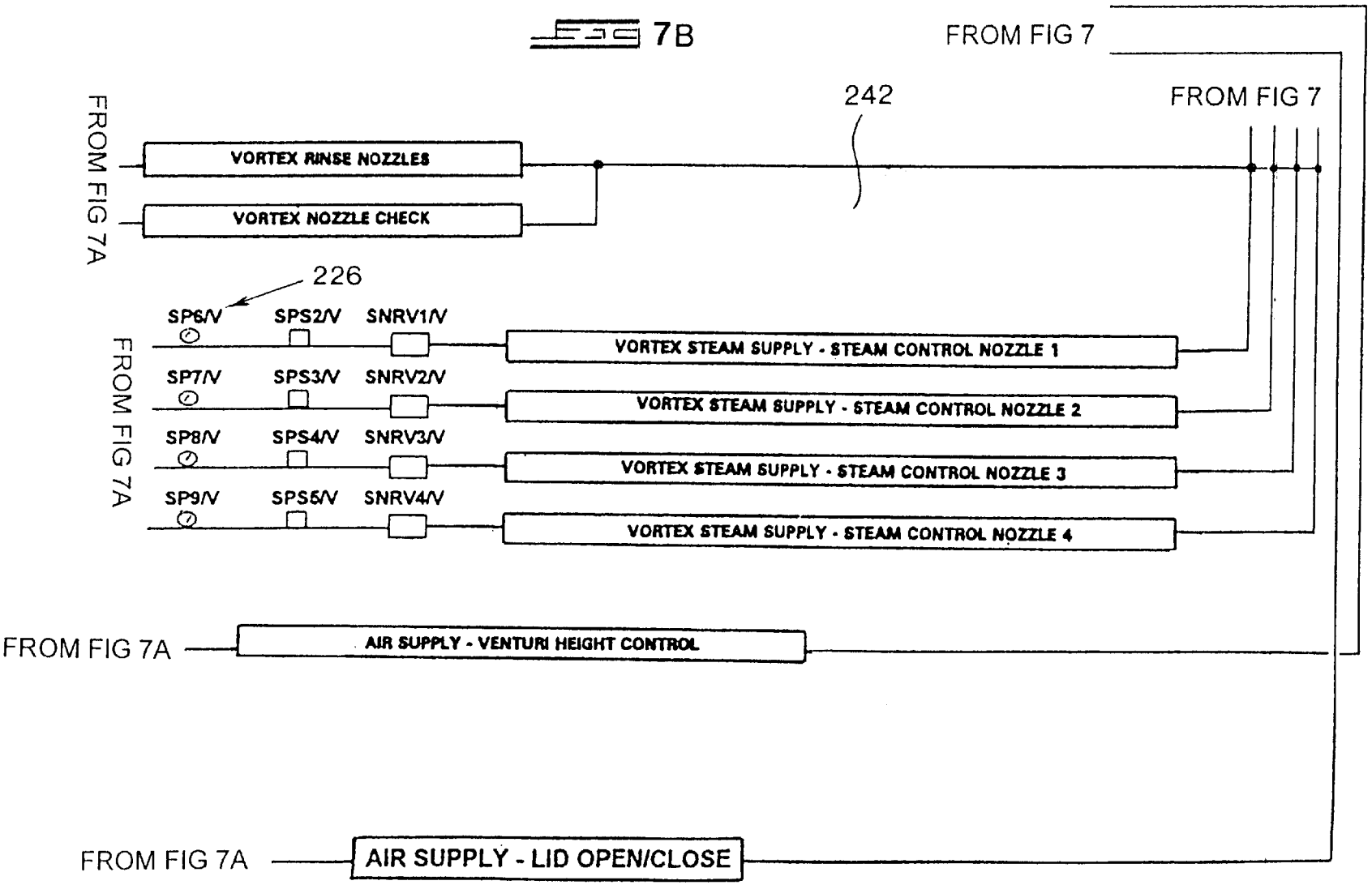
FIG 7B
FROM FIG 7
FROM FIG 7
242
VORTEX RINSE NOZZLES
VORTEX NOZZLE CHECK
VORTEX STEAM SUPPLY - STEAM CONTROL NOZZLE 1
VORTEX STEAM SUPPLY - STEAM CONTROL NOZZLE 2
VORTEX STEAM SUPPLY - STEAM CONTROL NOZZLE 3
VORTEX STEAM SUPPLY - STEAM CONTROL NOZZLE 4
AIR SUPPLY - VENTURI HEIGHT CONTROL
AIR SUPPLY - LID OPEN/CLOSE
226
SNRV1/V
SNRV2/V
SNRV3/V
SNRV4/V
SPS2/V
SPS3/V
SPS4/V
SPS5/V
SP6/V
SP7/V
SP8/V
SP9/V
FROM FIG 7A
FROM FIG 7A
FROM FIG 7A
FROM FIG 7A 8A
8
8B
32
208-1
208-2
208-3
208-4
250
252
190
192
194
196
264
266
200
270
268
32A
258
256
261
260
262
254
253
54A
12A
170A
50A
272
58A

METHOD AND APPARATUS FOR THE ENHANCEMENT OF TOBACCO

FIELD OF THE INVENTION

This invention relates to a method and apparatus for the enhancement of tobacco.

BACKGROUND TO THE INVENTION

Tobacco undergoes several treatment steps before it is ready to be formed into cigarettes and the like. The shredded tobacco is fed to a tobacco enhancement apparatus which is used to increase the effective volume of the tobacco by causing it to expand or "puff".

In one method, the tobacco is passed over an elongate tray formed with a heated plenum having a closely spaced matrix of nozzle openings. The plenum is heated to a temperature of approximately 145° C. by steam passing through the openings, thereby causing the tobacco shreds to expand. In the case of pressurized steam existing within the plenum at pressures of up to 1 MPa, the plenum can be heated to a temperature of up to 180° C. The individual tobacco shreds tend to form a mat which comes into direct contact with the heated plenum and the high temperature steam in the region of the openings; this tends to adversely affect the quality of the tobacco. In addition, due to the large volume of steam passing through the nozzles in the matrix, and the free volume above the mat, the above described process is not extremely energy efficient.

SUMMARY OF THE INVENTION

According to a first aspect of the invention there is provided a tobacco enhancement apparatus comprising a tunnel having a vibratory conveyor floor for advancing tobacco shreds, an inlet for receiving unexpanded tobacco shreds, a steaming and vortex creating station comprising an array of overhead steam nozzles arranged above the floor for steaming, swirling and expanding the shreds, and a conditioning station located downstream of the steaming station for prolonging the exposure of the expanded tobacco shreds to conditions of increased vapour pressure.

In a preferred form of the invention, the conditioning station comprises a venturi station, with the cross sectional area of the tunnel decreasing towards a minimum cross sectional area at the venturi station.

Preferably, the array of steam nozzles comprise a plurality of spaced apart steam manifolds extending transversely relative to the major axis of the tunnel, each of the steam manifolds having downwardly angled steam nozzles.

Conveniently, tilt angle adjustment means are provided for adjusting the downward tilt angles of the steam nozzles.

Advantageously, height adjustment means are provided for adjusting the height of the steam nozzles above the floor.

Preferably, area adjustment means are provided for varying the minimum cross sectional area at the venturi station by adjusting the effective height of the tunnel relative to the floor.

Typically, the pressure of steam exiting through the steam nozzles is adjustable via steam pressure adjustment means.

Control means are preferably provided for automatically controlling the operation of at least one of the adjustment means.

Conveniently, the control means includes a setpoint controller, and monitoring means are provided for monitoring and sensing the condition of at least one and preferably all of the controlled adjustment means.

In one form of the invention, a wetting station is located downstream of the inlet and upstream of the steaming station, the wetting station being arranged to pre-wet the tobacco shreds, and including at least one array of water nozzles.

The invention extends to a method of enhancing tobacco comprising the steps of feeding unexpanded tobacco shreds into an inlet of a tunnel having a vibratory conveyor floor for advancing the shreds, steaming and swirling the tobacco shreds at an overhead steaming and swirling station so as to expand the shreds, and conditioning the expanded tobacco shreds downstream of the steaming and swirling station by progressively decreasing the cross sectional area of the tunnel in the direction of travel of the expanded tobacco shreds to a minimum cross sectional area.

Preferably, the steaming and swirling station comprises a plurality of overhead steam manifolds having downwardly angled steam nozzles, the method including the step of adjusting the tilt angles of the steam nozzles to desired setpoint values.

Conveniently, the method includes the step of monitoring and adjusting the pressure of steam exiting through the steam nozzles to desired setpoint values.

Advantageously, the method further includes the step of monitoring and adjusting the height of the steam manifolds above the floor to at least one desired setpoint value.

Typically, the method includes the further step of monitoring and adjusting the minimum cross sectional area of the tunnel to a desired setpoint value.

The method advantageously includes the step of monitoring and adjusting the temperature of the expanded tobacco to a desired setpoint value.

Typically, a steam or vapour extractor is positioned downstream of the venturi station.

BRIEF DESCRIPTION OF THE DRAWINGS

FIG. 2 shows a more detailed partly cross-sectional side view of the tobacco enhancement apparatus of FIG. 1;

FIG. 8A shows a detail of a steam manifold adjustment mechanism forming part of the second embodiment of the tobacco enhancement apparatus;

FIG. 8B shows a detail of a height adjustment mechanism for varying the height of a venturi station forming part of the tobacco enhancement apparatus of FIG. 8;

DESCRIPTION OF THE EMBODIMENTS

Figure 1:
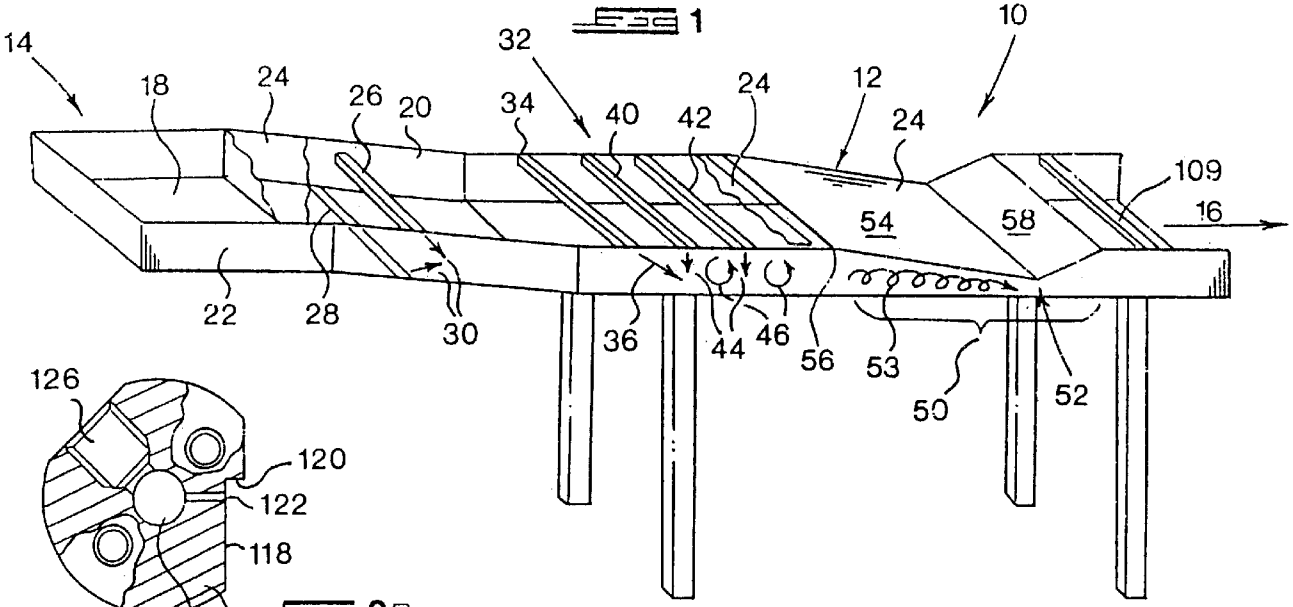
FIG. 1 shows a highly schematic partly cut away perspective view of a first embodiment of a tobacco enhancement apparatus of the invention.

Referring first to FIG. 1, a tobacco enhancement apparatus 10 is in the form of an elongate vibratory tunnel 12 having an inlet 14 for receiving unexpanded tobacco shreds, and an expanded tobacco outlet 16. The tunnel 12 is typically 4.5 meters long and around 0.4 to 1.0 meters wide, and comprises an elongate vibratory conveyor floor or plenum 18, side walls 20 and 22 and a series of top walls or lids 24.

Located downstream of the inlet 14 are a pair of moisturizing or wetting upper and lower manifolds 26 and 28. One such manifold is illustrated in more detail in FIGS. 4A and 4B, and is formed with a plurality of nozzles which are arranged to direct fine jets of atomized water in the directions of arrows 30, which are angled both downstream and towards the centre of the tunnel.

The moisturizing manifolds 26 and 28 constitute a moisturizing station. and are arranged to pre-wet the unexpanded tobacco shreds. The unexpanded shreds are then directed by the action of the jets towards a steaming station 32. The steaming station 32 comprises a first angled overhead steam manifold 34 extending between the walls 20 and 22 of the tunnel and arranged to direct steam jets at a downward and forward oblique angle. Located just downstream of the angled steam manifold 34 are a pair of generally vertically orientated steam manifolds 40 and 42 which are arranged to direct jets of steam downwardly and vertically in the direction of arrows 44. The steam manifold 34 and the steam manifold 40 are spaced approximately 100 mm apart from one another, and the steam manifolds 30 and 42 are spaced approximately 75 mm apart from one another with all three overhead steam manifolds 34, 40 and 42 being raised approximately 100 mm above the floor 18 of the tunnel. The relative positioning of the nozzles creates a series of vortices 46 over a distance of approximately 200 mm at the steaming station 32. As a result, the tobacco shreds are momentarily held captive by swirling in the region of the steaming station 32, thereby ensuring that all of the individual shreds are evenly and fully exposed to the jets of steam so as to allow for uniform puffing or expansion of the tobacco shreds.

During the steaming and swirling operation, the moisture in the individual cells of the tobacco shreds is vaporized, thereby causing expansion of the cells. The speed at which this conversion takes place correlates directly with the degree of expansion or "puff" that is obtained. It is highly desirable that maximum increase in volume of the tobacco shreds is obtained without overreaching the elasticity limits of the individual tobacco cells. Exceeding these limits will naturally damage the cell walls, thereby causing a concomitant reduction in flavour.

At a venturi station 50. the cross-sectional area and thus the volume of the tunnel 12 progressively decreases downstream of the steaming station 32 to a minimum height at location 52 of as little as 20 mm. A cover flap 54, which pivots about axis 56, can be adjusted to control the rate in decrease of the height, together with the minimum effective height at the location 52. Owing to the progressive decrease in the area, both heat and humidity losses in the individual tobacco shreds are reduced. Further, the venturi configuration causes an increase in the velocity of the tobacco particles, which continue to swirl in the manner indicated schematically by arrow 53. The continued swirling of the tobacco shreds prevents them from settling in the form of a mat on the floor or plenum 18. The venturi station makes optimal use of the steam energy at the lowest possible steam pressure. The vapour pressure within the individual tobacco shreds is maintained during their passage through the venturi station, thereby ensuring that the individual tobacco shreds, whilst still wet and elastic, do not lose their volume, and maintain the individual cell vapour pressure for a sufficient time so that each cell stabilizes in the expanded or enhanced condition.

Referring now to FIG. 2, a more detailed side view of the enhancement apparatus 10 is shown. It can clearly be seen how the upper and lower moisturizing manifolds 26 and 28 are mounted between a pair of plates 60. Arcuate pairs of upper and lower adjustment slots 62 and 64 are formed in the plates so as to allow the angles of the moisturizing manifolds to be adjusted.

Figure 4A:
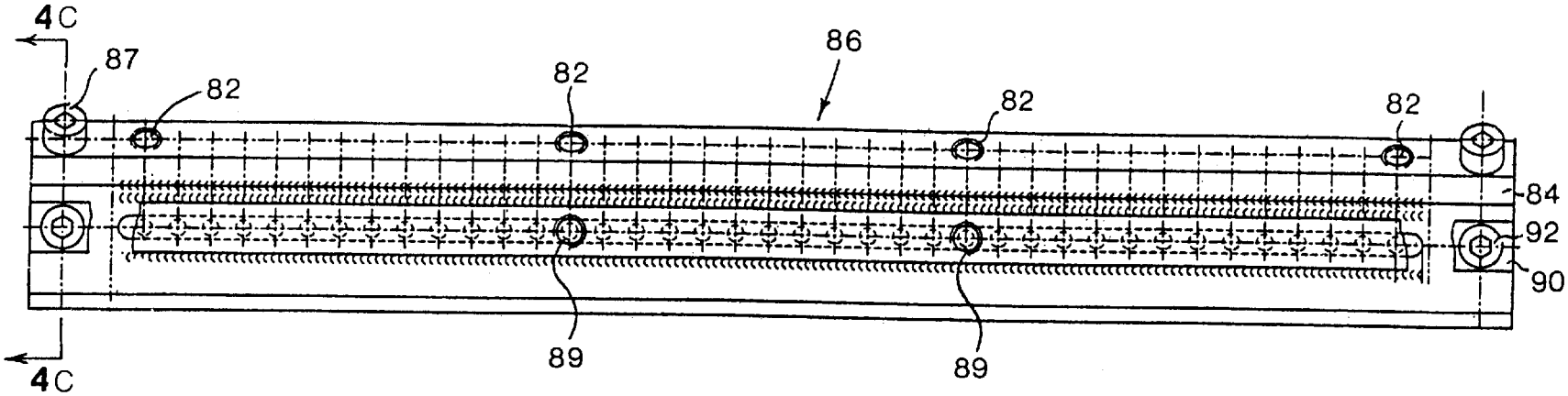
FIGS. 4A, 4B & 4C show respective rear and cross-sectional side views of a moisturizing manifold forming part of the first embodiment of the tobacco enhancement apparatus of the invention.
Figure 4B:
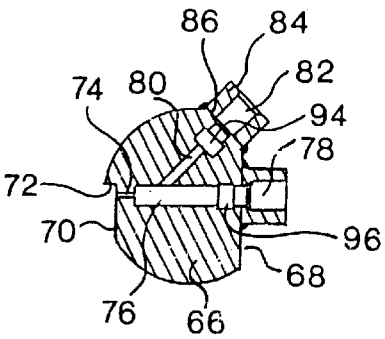
Figure 4C:
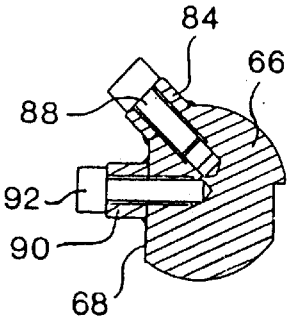

FIGS. 4A to 4C illustrate a more detailed view of the moisturizing manifold. The body of the manifold comprises a round bar 66 which is formed with a flat rear surface and an undercut front surface 70 formed with an overhanging shoulder 72 above a nozzle outlet 74, which has a diameter of 0.5 mm. Thirty nine of such outlet nozzles are provided at evenly spaced intervals. The outlet nozzles in turn communicate with a venturi chamber 76 having a high pressure air inlet 78 and an oblique water inlet 80. Four evenly spaced water inlet nozzles 82 are formed through a square bar 84 which is welded and bolted to a chamfered surface 86 of the body 66 by means of bolts 88. Two equi-spaced air inlet nozzles 89 are similarly formed in a square bar 90 which is welded and bolted by means of bolts 92 to the flat rear surface 68 of the body 66. An interconnecting passageway 94 extends transversely along the length of the body so that water is distributed evenly through the separate water inlets 80 into the venturi chambers 76. Similarly, an elongate connecting passage 96 ensures that pressurized air is distributed evenly into the thirty nine venturi chambers 76. Water is typically sprayed from the nozzles at a pressure of 500 kPa to 600 kPa and a temperature of 15° C., with the resultant water consumption being approximately 90 $lh^{-1}$.

Referring back to FIG. 2 a water outlet or sump drain 102 is formed with an hydraulic ram 104 which is arranged to selectively open and close a blocking pate 106 via a linkage arm 108 for allowing water to drain from the floor 18 of the passageway. The floor 18 slopes downwardly towards the sump drain 102, which is principally used during periodic rinsing and cleaning operations. A rinsing manifold 109 is used in conjunction with the wetting manifolds 26 and 28 to wash down the floor 18.

Figure 3B:
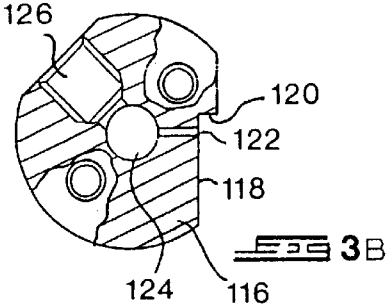
FIGS. 3A & 3B show respective front and cross-sectional side views of a steaming manifold forming part of the enhancement apparatus of FIG. 1.
Figure 3A:
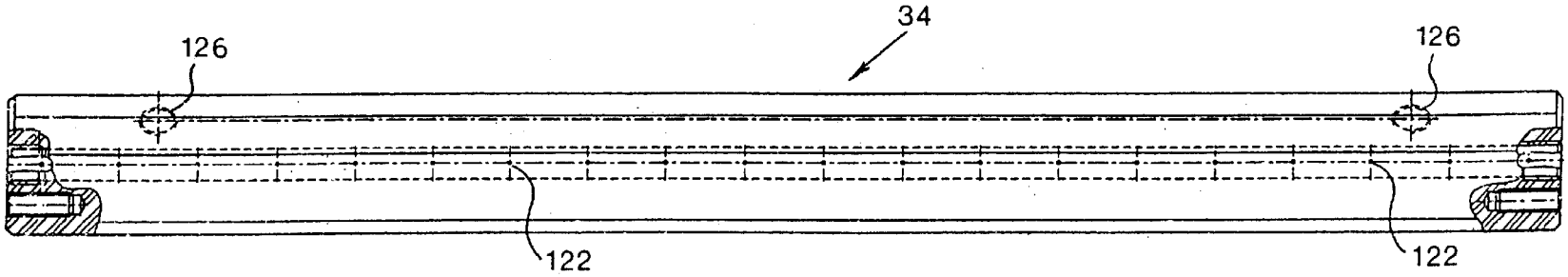

A canvas curtain or flap 110 divides the moisturizing station from the steaming station 32. As was the case with the moisturizing manifolds, the angled steam manifold 34 as well as the vertical steam manifolds 40 and 42 are mounted between adjustment plates 112 formed with arcuate slots 114 which allows the angle of the manifolds to be adjusted via adjusting bolts 115. The steam manifold 34 is illustrated in more detail in FIGS. 3A and 3B, and comprises a body in the form of a round bar 116 having a recessed front surface 118 formed with an overhanging shoulder 120 adjacent a nozzle outlet 122 having a diameter of 1mm. The nozzle outlet in turn communicates with an interior steam manifold chamber 124. A pair of steam inlet apertures 126 are provided towards opposite ends of the manifold, which includes twenty equi-spaced steam outlet nozzles 122. The overhanging shoulder 120 on the steam manifolds as well as the overhanging shoulder 72 on the moisturizing manifolds is used to protect the nozzle openings and to prevent build up thereon. Steam is dispensed from the manifolds at a pressure of 600 kPa to 800 kPa and a temperature of 165° C. The total steam consumption is approximately 115 $kgh^{-1}$.

A dividing curtain 130 is located at the head of the venturi station adjacent the pivot axis 56 of the pivot plate 54. A further curtain 132 is suspended from the pivot axle 134 of the pivot plate 58. A series of apertures 140 are formed in a pair of opposed side walls 142 and 144. Mounted on the pivot plate is an angle adjuster 146 comprising a pair of adjustment arms 148 and 150 connected to respective adjustment shafts 152 and 154 which terminate in pins 156 arranged to locate within the apertures 140. The pins and the arms 148 and 150 are biased outwardly by means of compression springs 158. In order to move the plate up or down, the arms 148 and 150 are pushed towards one another, thereby releasing the pins 156 from the apertures 140 within which they are engaged. The entire plate 54 can then be moved up or down to a desired angle, at which stage the arms are released so that the pins 156 locate within the nearest set of apertures 140 at that particular angle of adjustment. The pivot plate 58 is formed with a similar set of apertures 160 and a corresponding angle adjuster (not shown).

The entire tunnel 12 is mounted on a vibrating structure comprising a vibrating table '164 having rigid legs 166 supporting a rigid top 168. An array of leaf springs 170 connect the top surface of the table to the tunnel. A vibratory motor 170 is linked via a fanbelt 172 to an upper pulley 174 carrying an offset vibrator arm 176 which is arranged to vibrate both the tray as well as an elongate counterweight 178 located beneath the tray. The counterweight 178 is similarly linked to the top 168 of the table by means of leaf springs 180 and is arranged to vibrate in the opposite direction as that of the main tray, so as to counteract the net effect of the vibrations on the table.

An extraction hood 180 having a pair of extraction inlets 182 and 184 is arranged to extract all excess steam and vapour from the expanded tobacco particles. The outlet 16 extends into a rotary dryer 186 where the expanded tobacco particles are dried before being processed further.

Figure 5:
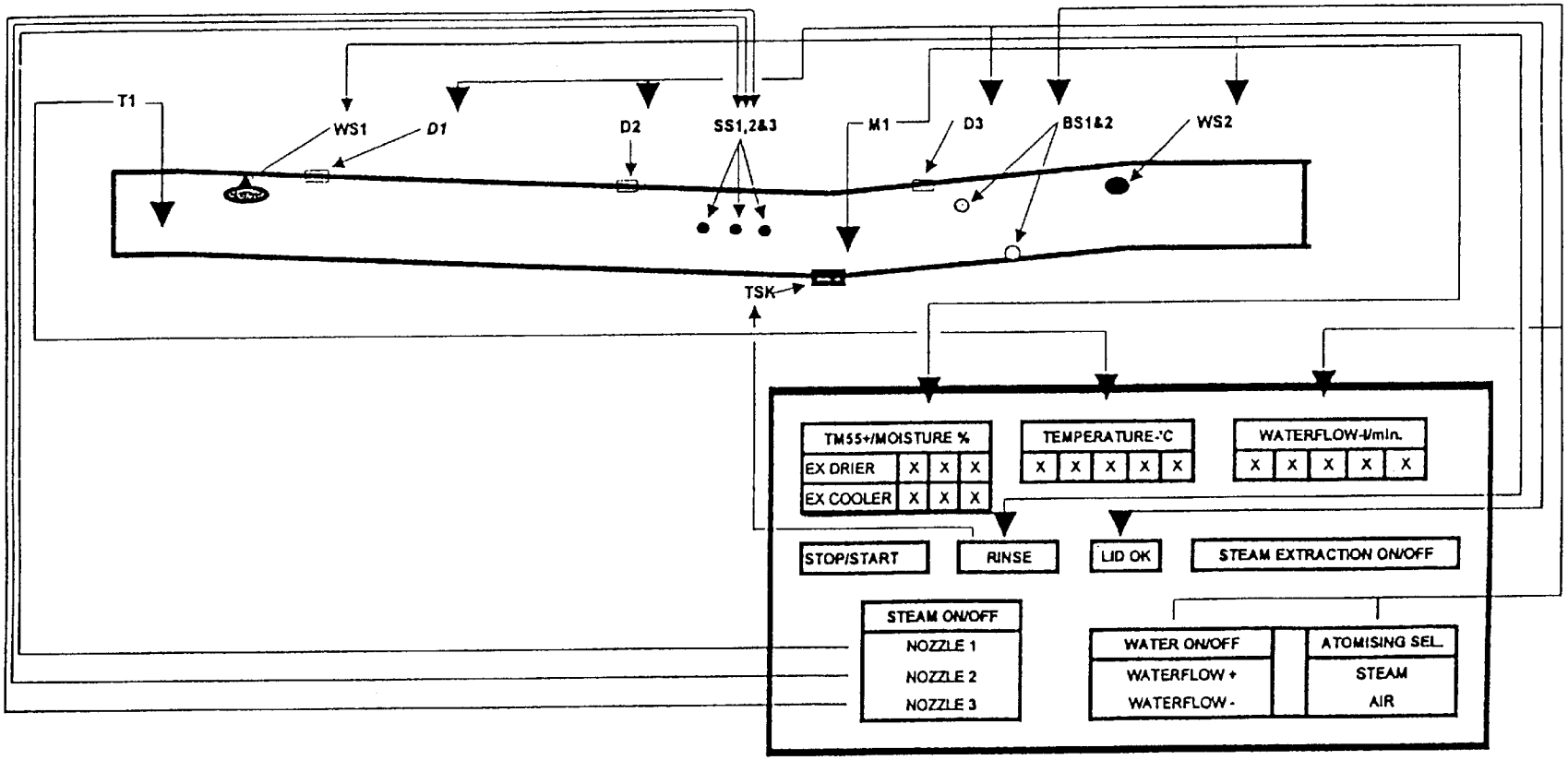
FIG. 5 shows a schematic control diagram of the first embodiment of the enhancement apparatus of the invention.
Figure 5A:
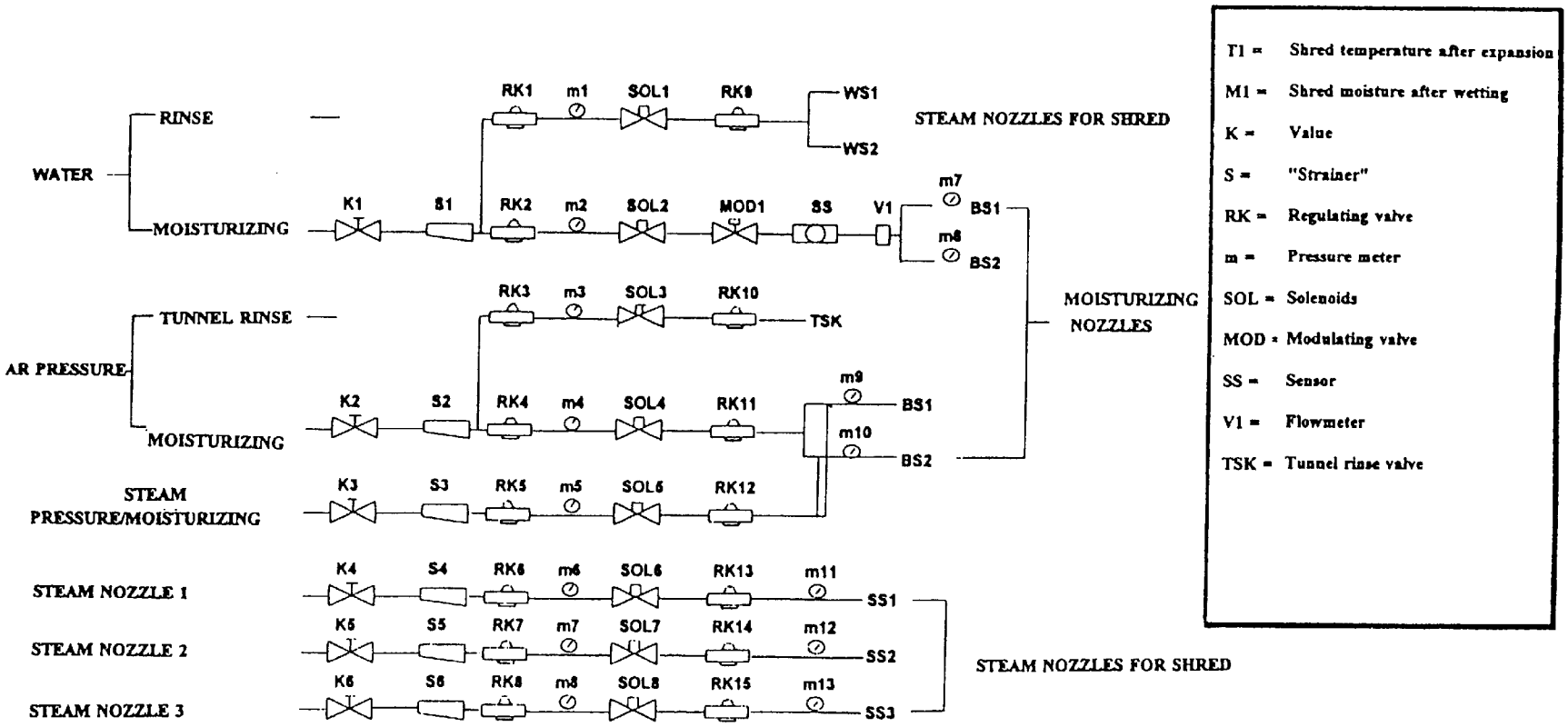

Referring now to FIG. 5, a control diagram of the aforementioned enhancement apparatus is shown, the contents of which are self-explanatory, indicating the various control valves and temperature, pressure and flow sensing apparatus used to control the operation of the enhancement apparatus.

Figure 6:
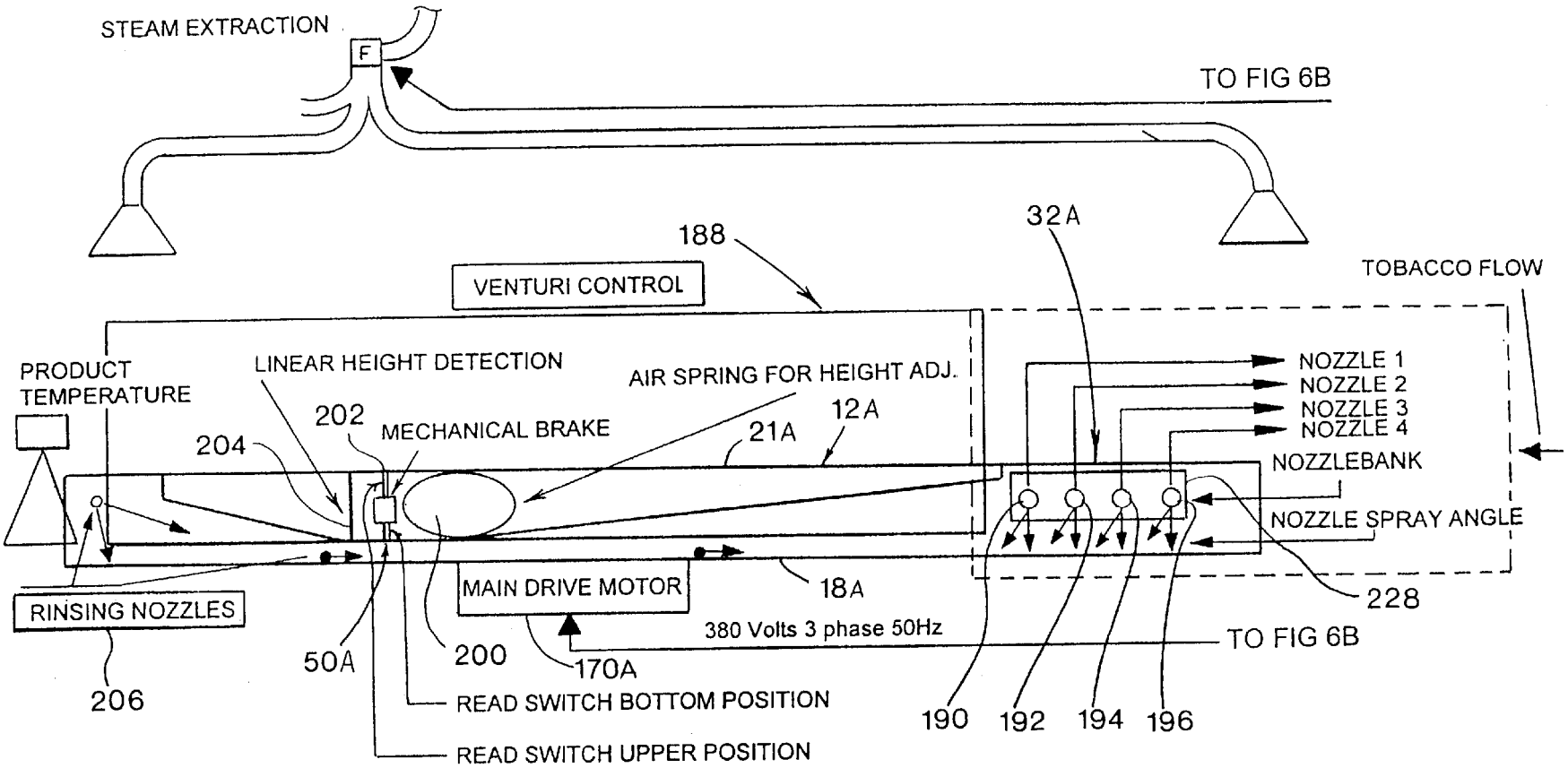
FIG. 6 shows a schematic control diagram of a second automated embodiment of a tobacco enhancement apparatus of the invention.
Figure 6A:
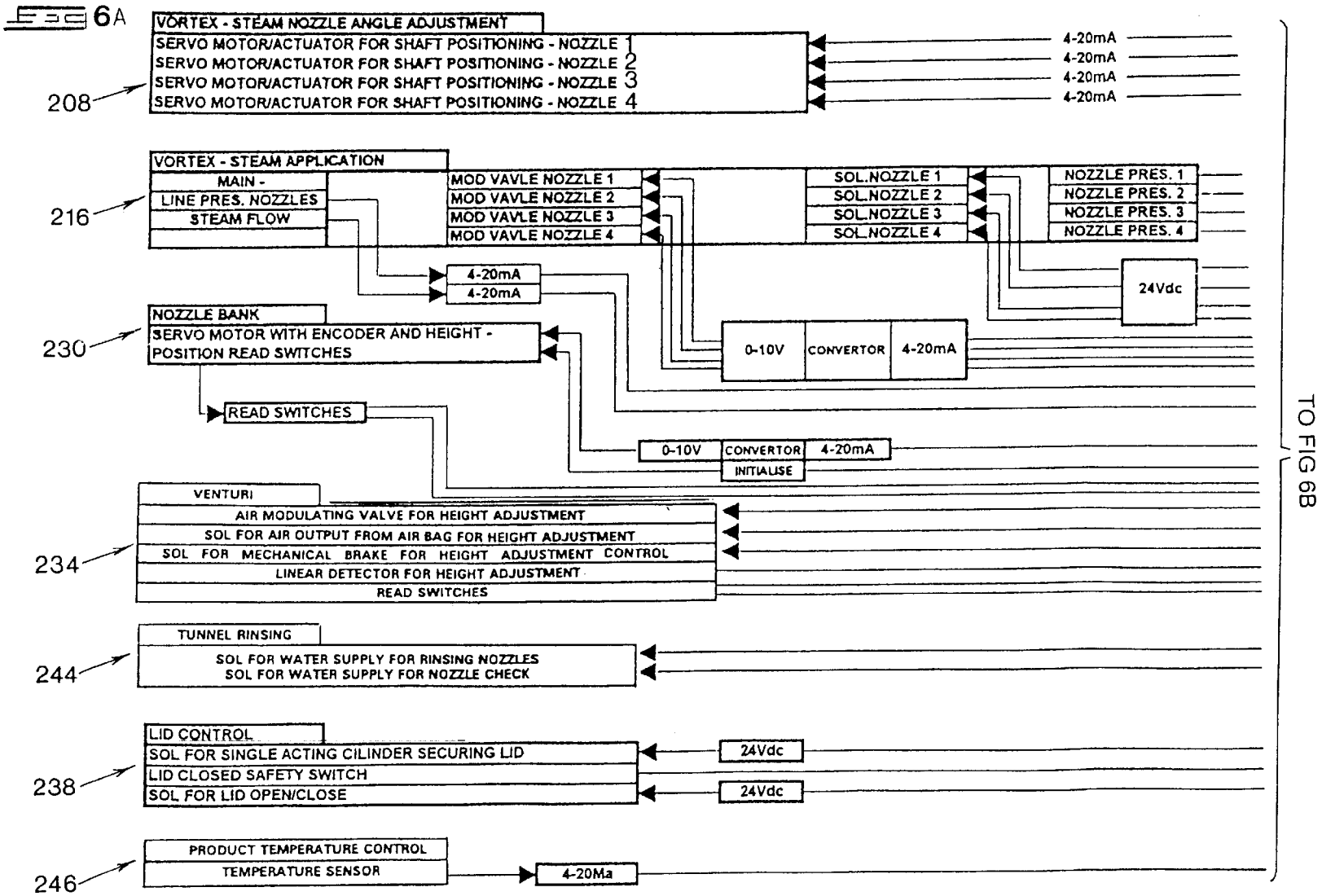
Figure 6B:
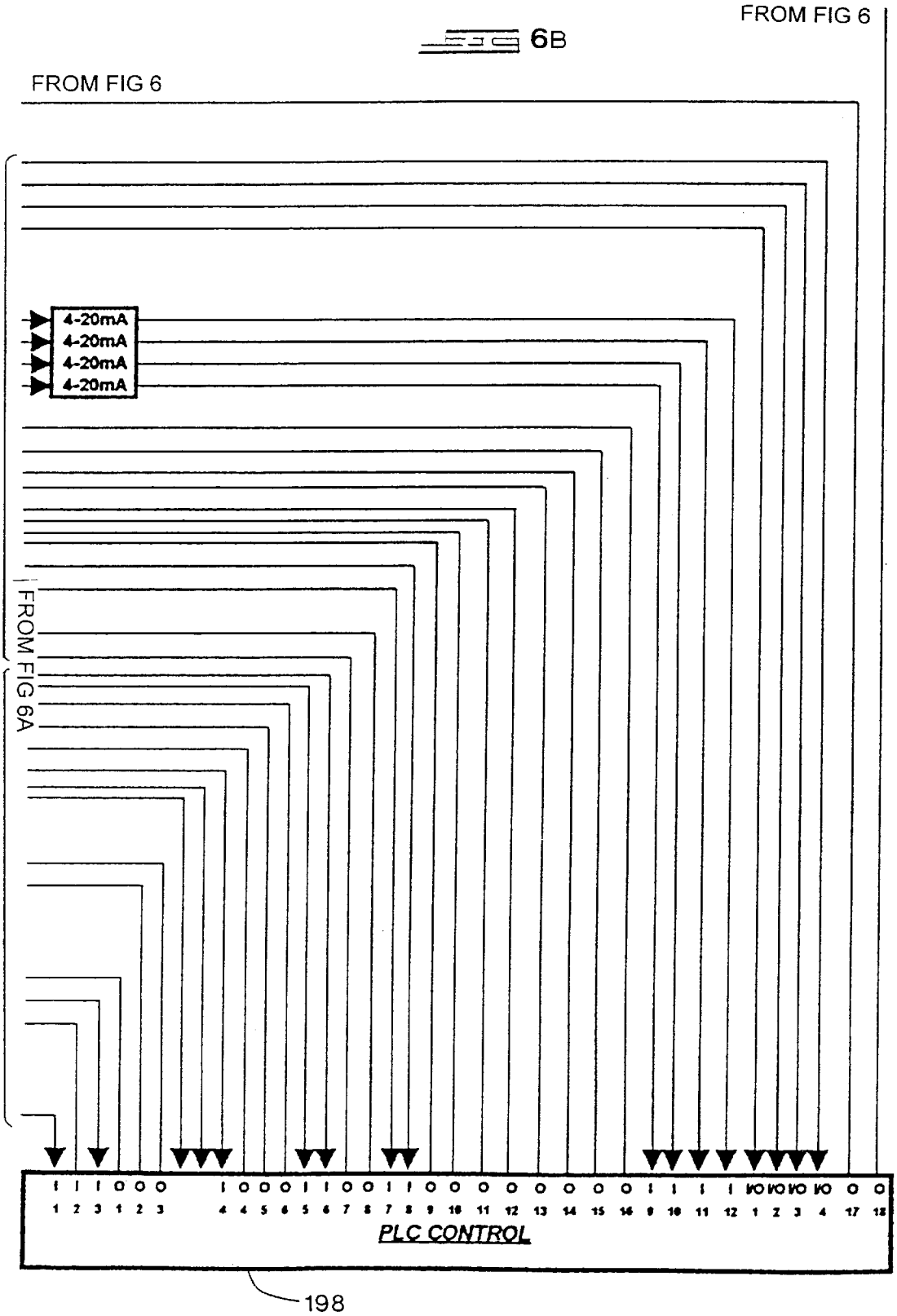

In FIG. 6, a second embodiment of a preferred automated version of the tobacco enhancement apparatus 188 is provided. Those components of the tobacco enhancement apparatus 188 which are similar to the first embodiment of the tobacco enhancement apparatus are identified by the same numerals suffixed with an "A".

The steaming station 32A comprises a nozzle bank of four steam manifolds 190, 192, 194 and 196. A PLC controller 198 controls the operation of the automated tobacco enhancement apparatus 188. In particular, it provides for automated control of the spray angle of each of the four steam manifolds 190, 192, 194 and 196, as well as the volume, pressure and temperature of steam passing through the manifolds.

At the venturi station 50A, an air spring 200 is used to automatically adjust the height of the venturi station in conjunction with a mechanical brake 202 and a linear height detector 204. The various tunnel rinsing nozzles 206 are also controlled automatically, as is the tunnel lid 24A.

Figure 7:
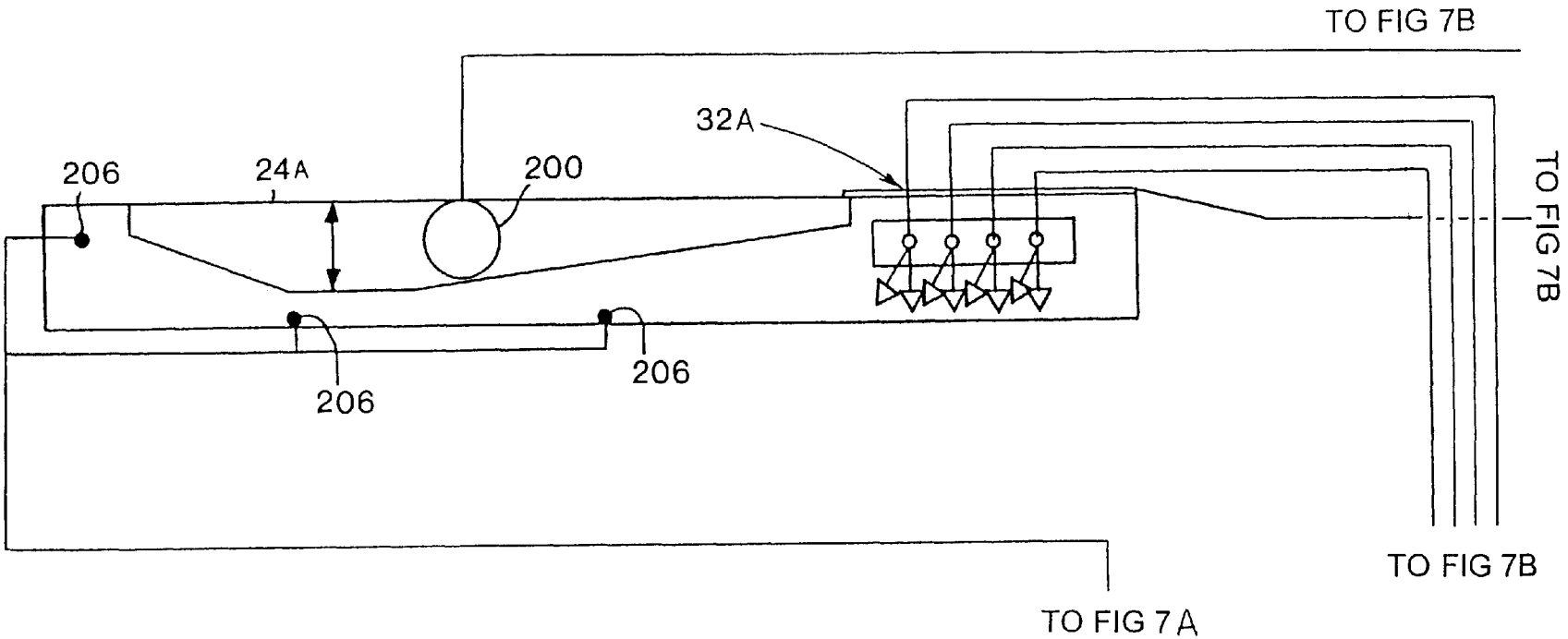
FIG. 7 shows a schematic control diagram of the second embodiment of the tobacco enhancement apparatus illustrating the air, water and steam supply lines.
Figure 8:
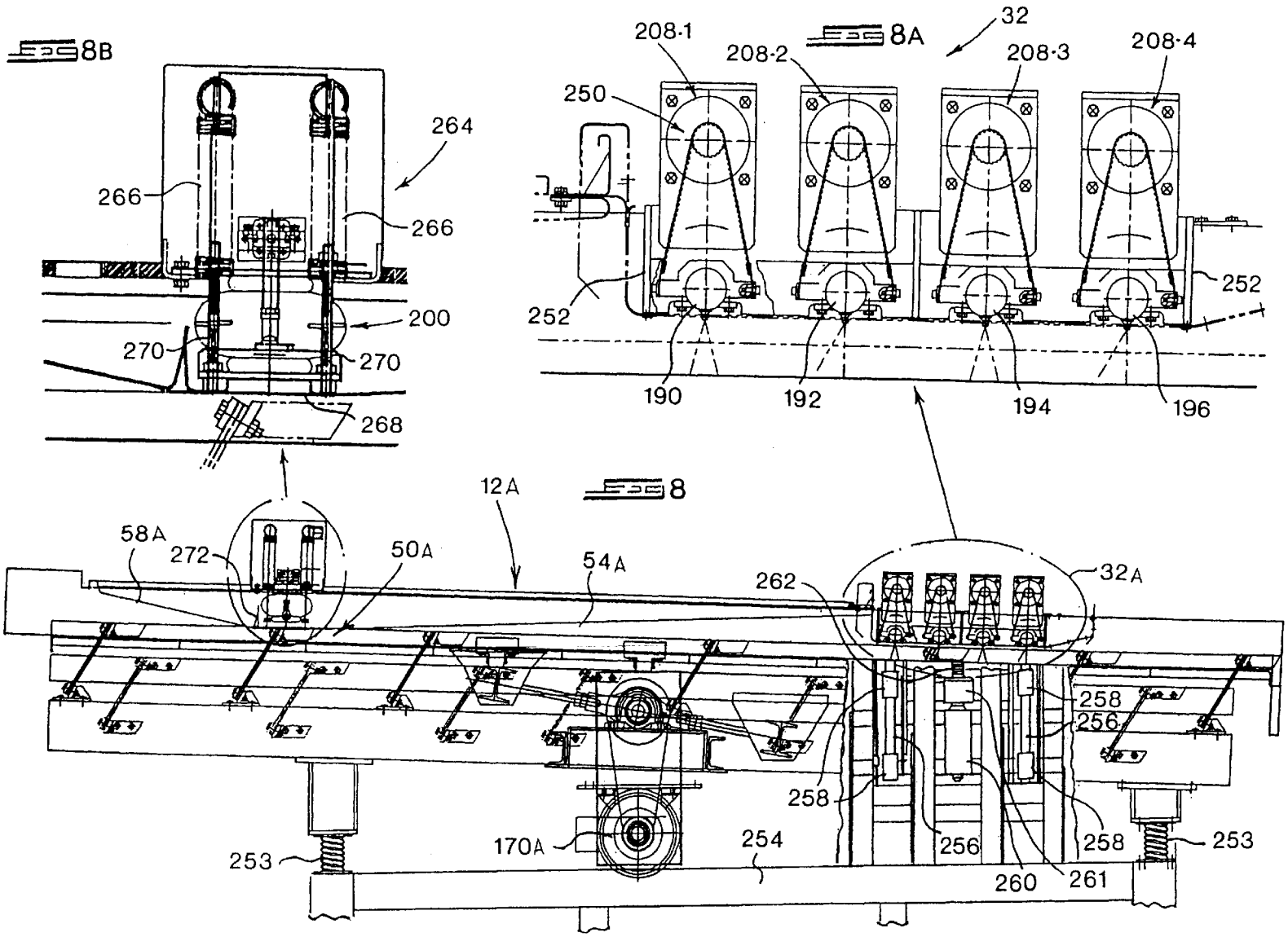
FIG. 8 shows a side view of the tobacco enhancement apparatus of FIGS. 6 and 7.

Adjustment of the spray angle of the steam manifolds is achieved by means of four servo-motors indicated schematically at 208. The manner in which the main water, steam and air supply lines 210, 212 and 214 are used to automatically control the operation of the aforementioned automated components by means of the PLC controller 198 is illustrated in FIG. 7 read in conjunction with FIG. 6. The main steam supply 212 branches into four separate lines 212.1, 212.2, 212.3 and 212.4 which feed the respective steam manifolds 190, 192, 194 and 196. The manner in which the supply of steam is controlled and regulated to feed the separate steam manifolds is clearly illustrated in FIG. 6 at 216 with reference to the electrical control signals and at 218 in FIG. 7, and will be clear to the normally skilled addressee. In particular, the operation of the steam solenoid valves 220 and the steam modulating valves 222 in conjunction with the respective steam pressure gauges 224 and 226 respectively should be noted.

In addition to the angle of the nozzles being automatically adjustable, the overall height of the bank 228 of nozzles making up the steaming station is adjustable by means of a servo-motor arrangement, as is shown at 230. The main air supply line 214 leads to a first branch line 232 which feeds the air spring 200 for controlling the height of the venturi station 50A. The various height sensors and controls are illustrated at 234. A second branch 236 of the main air supply line controls opening and closing of the lid 24A, with the various control elements being illustrated at 238.

The water supply line 210 leads to separate branch lines 240 and 242 which lead to the tunnel rinse nozzles 206 and to the separate steam outlet manifolds 190, 192, 194 and 196 respectively for rinsing the steam nozzles. The tunnel rinse outputs are illustrated schematically at 244. A temperature sensor 246 is provided at the output of the tunnel for measuring the temperature of the enhanced tobacco particles.

The automated tobacco enhancement apparatus is illustrated in more detail in FIGS. 8, 8A, 8B and 9. The steam manifolds 190, 192, 194 and 196 are adjusted by means of individual servo-motors 208.1, 208.2, 208.3 and 208.4 respectively which drive the main shafts of each of the steam manifolds 190 to 196 via toothed pinion and belt arrangements 250. The entire steaming station 32A is mounted to a carriage 252 which is in turn mounted via coil springs 253 to the stationary main frame 254 of the tobacco enhancement apparatus via a pair of guide shafts 256 passing through guide sleeves 258 fixed to the main frame. A servo-motor 260 is similarly mounted to the main frame, and drives a worm 262 which locates within a complemental sleeve 261 on the carriage for adjusting the vertical height of the carriage and the manifold array. The steaming station 32A thus remains fixed as the tunnel 12A vibrates.

Referring now to FIG. 8B, the air spring 200 forms part of an adjustable venturi height mechanism 264 for adjusting the overall height of the venturi station. The adjustment mechanism 264 comprises a pair of tension springs 266 which support a base plate 268 defining the roof of the venturi station via shafts 270. The base plate 268 merges into an upwardly slanting cover flap 54A extending towards the steaming station 32A. The other end of the base plate is connected via a hinge 272 to an opposed upwardly slanting cover flap 58A. It can clearly be seen that inflation of the air spring 200 will act against the tension springs 266 so as to lower the roof 268 of the venturi station, and deflation of the air spring 200 will cause the tension springs 266 to pull the roof 268 upwards, thereby raising the height of the venturi station.

Figure 9:
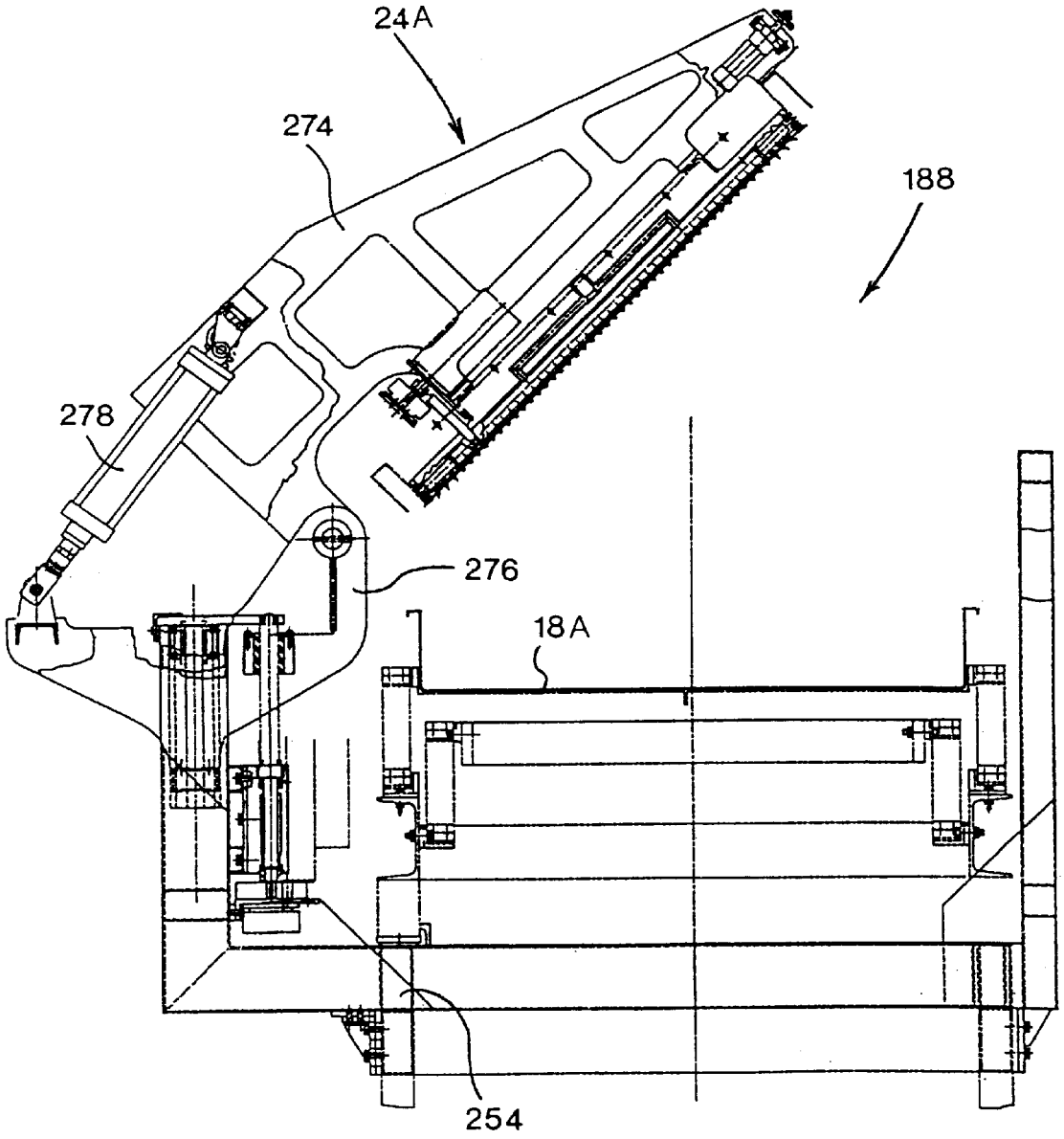
FIG. 9 shows a partly cutaway end view of the tobacco enhancement apparatus of FIG. 8.

Referring now to FIG. 9, the lid 24A is supported on overhead jib arms 274, each of which is pivoted on a support 276. The support 276 extends from the base frame 214, and also carries a pneumatic ram 278 for enabling the lid 24A to be automatically opened and closed. The lid 24A carries most of the overhead apparatus apart from the steaming station 26A, and the associated venturi height mechanism 264 and cover flaps 54A and 58A, thereby facilitating maintenance procedures.

Figure 10:
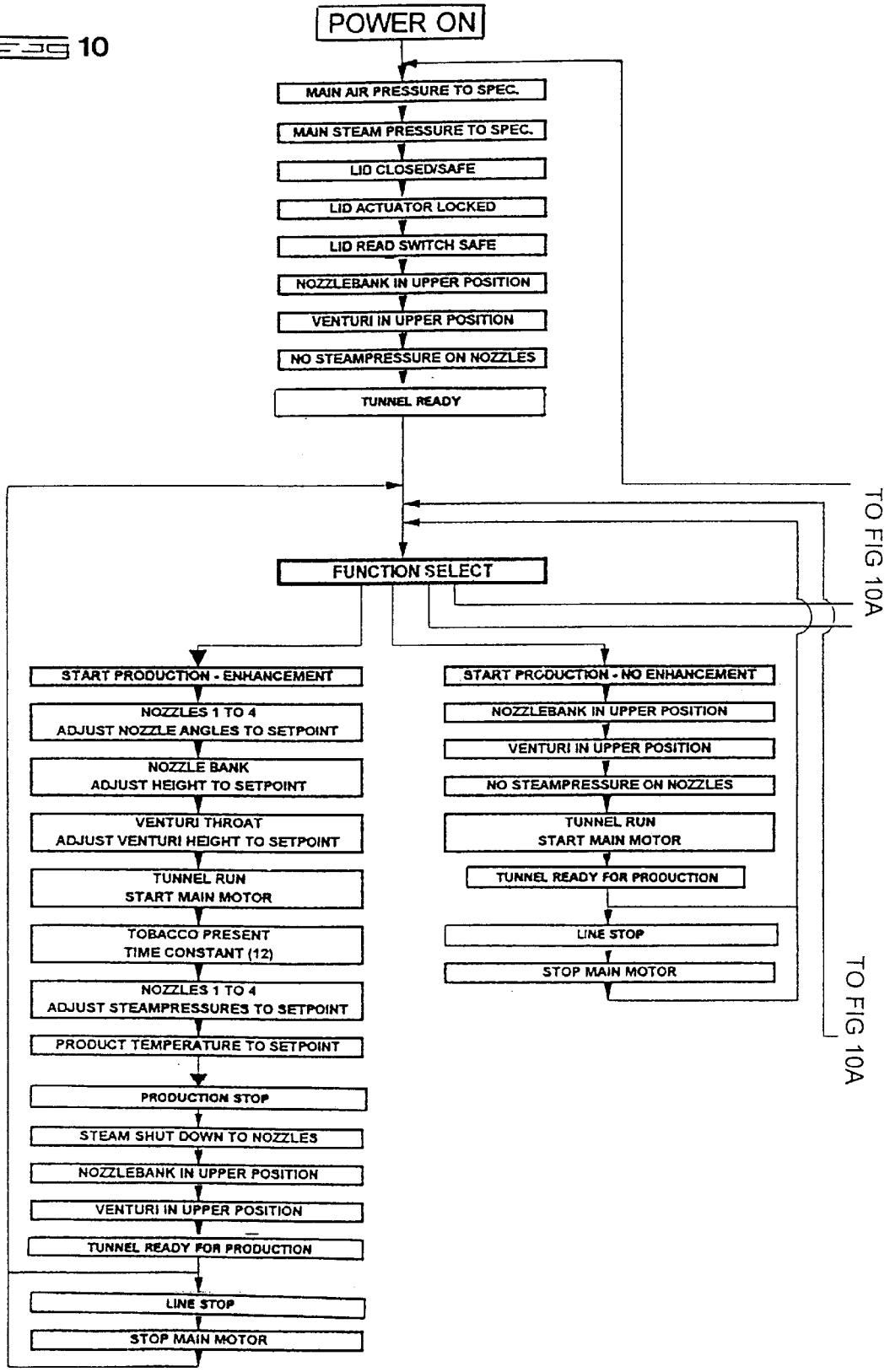
FIG. 10 shows a flow diagram illustrating the operational sequence of the tobacco enhancement apparatus of FIG. 8.
Figure 10A:
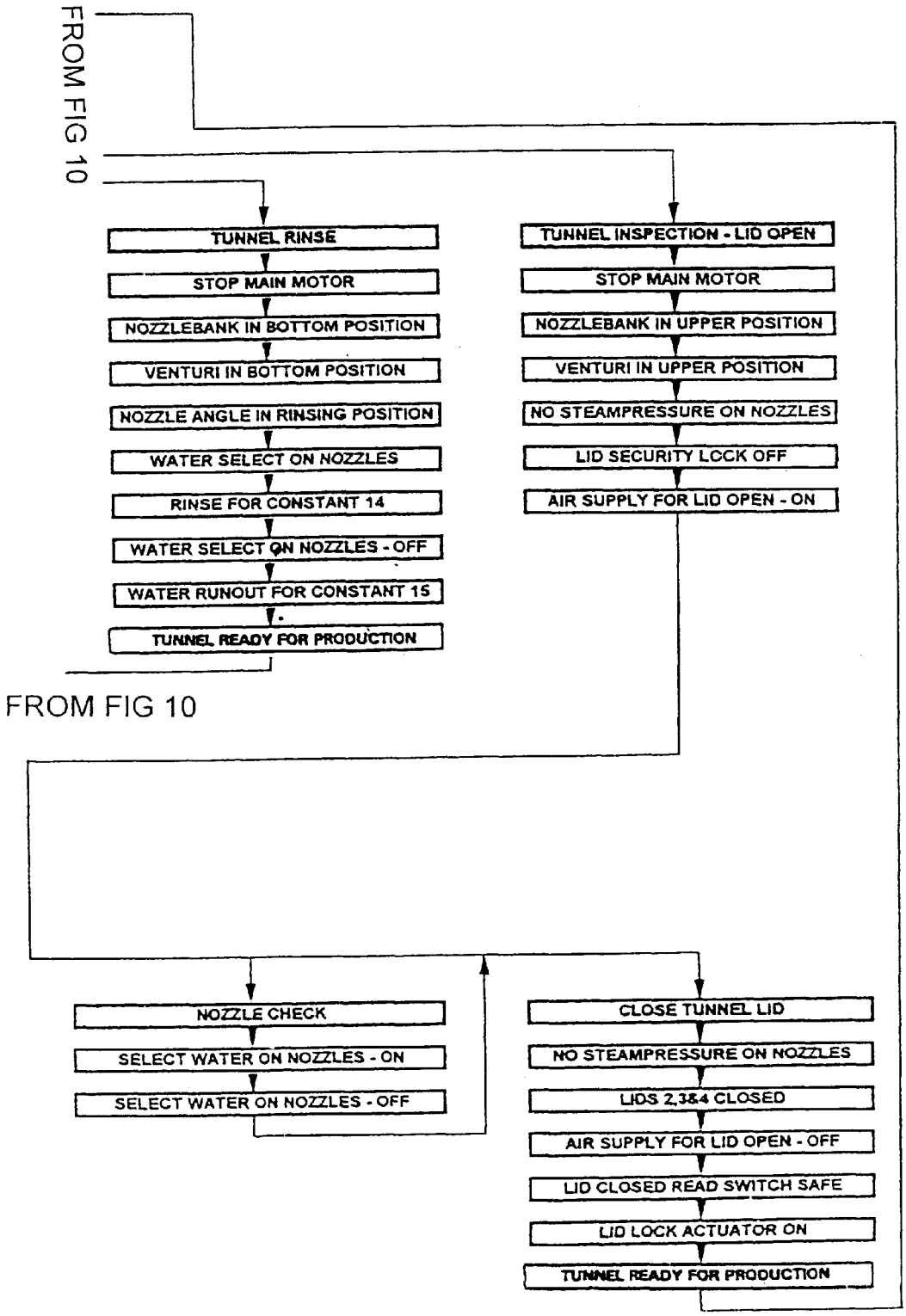

In FIG. 10, which is self-explanatory, a flow diagram illustrates the various modes of operation of the automated tobacco enhancement apparatus, as well as the operational sequence of each mode. Four main modes can be selected via the PLC controller, namely enhancement, no enhancement, tunnel rinse and tunnel inspection. In the particular embodiment, the vertical position of the bank of nozzles may be altered from a height of 50 mm to a height of 80 mm above the floor. The individual angles of the steam manifolds 190, 192, 194 and 196 are individually adjustable from 80 degrees to 100 degrees in respect of the first three manifolds and from 70 degrees to 90 degrees in respect of the manifold 196. The steam pressure in all four manifolds 190 to 196 can be adjusted from 0 to 900 kPa. In addition the time constant for the steaming station 32A is adjustable from 0 to 120 seconds in respect of both on and off cycles and from 0 to 240 seconds in respect of a tunnel rinse cycle. The product temperature is typically variable from 60 to 90 degrees at exit, and can be sensed at a temperature of up to 95 degrees C on its passage through the tunnel. Temperatures in excess of 95 degrees are generally avoided for the reasons described above with reference to the prior art.

The PLC controller 198 functions as a setpoint controller with, each of the above variables being individually programmable between the above upper and lower parameters. It has experimentally been discovered that the flavour of particular tobacco blends can be altered and enhanced by adjusting the above variables. By way of example, a typical "recipe" would involve steam pressures at the respective steam manifolds 190 to 196 being 300 kPa, 500 kPa, 500 kPa and 700 kPa. The angles at the respective steam manifolds 190 to 196 are 2 degrees, 15 degrees, 5 degrees and 15 degrees respectively in a forward direction relative to a zero degree vertical position. The exit temperature of the expanded tobacco will vary from 75 degrees to a maximum of 90 degrees C depending on the rate of expansion required.

The tobacco enhancement apparatus of the invention increases the effective volume of the tobacco shreds without adversely affecting their flavour, resulting in significant production savings. Further, the automated version increases the versatility of production and allows for the potential of varying flavours to be imparted to the same tobacco blends in a highly controlled environment.

What is claimed is:

1. A tobacco enhancement apparatus comprising a tunnel having a vibratory conveyor floor for advancing tobacco shreds, an inlet for receiving unexpanded tobacco shreds, a steaming and vortex creating station comprising an array of overhead steam nozzles arranged above the floor for steaming, swirling and expanding the shreds, and a conditioning station located downstream of the steaming station for prolonging the exposure of the expanded tobacco shreds to conditions of increased vapour pressure.

2. A tobacco enhancement apparatus according to claim 1 in which the conditioning station comprises a venturi station, with the cross sectional area of the tunnel decreasing towards a minimum cross sectional area at the venturi station.

3. A tobacco enhancement apparatus according to claim 2 in which the array of steam nozzles comprise a plurality of spaced apart steam manifolds extending transversely relative to the major axis of the tunnel, each of the steam manifolds having downwardly angled steam nozzles.

4. A tobacco enhancement apparatus according to claim 3 in which tilt angle adjustment means are provided for adjusting the downward tilt angles of the steam nozzles.

5. A tobacco enhancement apparatus according to claim 4 in which height adjustment means are provided for adjusting the height of the steam nozzles above the floor.

6. A tobacco enhancement apparatus according to claim 5 in which area adjustment means are provided for varying the minimum cross sectional area at the venturi station by adjusting the effective height of the tunnel relative to the floor.

7. A tobacco enhancement apparatus according to claim 5 in which the pressure of steam exiting through the steam nozzles is adjustable via steam pressure adjustment means.

8. A tobacco enhancement apparatus according to any one of claims 5, 6, or 7 which includes control means for automatically controlling the operation of at least one of the adjustment means.

9. A tobacco enhancement apparatus according to claim 8 in which the control means includes a setpoint controller, and monitoring means are provided for monitoring and sensing the condition of at least one of the controlled adjustment means.

10. A tobacco enhancement apparatus according to claim 1 in which a wetting station is located downstream of the inlet and upstream of the steaming station, the wetting station being arranged to pre-wet the tobacco shreds, and including at least one array of water nozzles.

11. A method of enhancing tobacco comprising the steps of feeding unexpanded tobacco shreds into an inlet of a tunnel having a vibratory conveyor floor for advancing the shreds, steaming and swirling the tobacco shreds at an overhead steaming and swirling station so as to expand the shreds, conditioning the expanded tobacco shreds downstream of the steaming and swirling station by progressively decreasing the cross sectional area of the tunnel in the direction of travel of the expanded tobacco shreds to a minimum cross sectional area.

12. A method according to claim 11 in which the steaming and swirling station comprises a plurality of overhead steam manifolds having downwardly angled steam nozzles, the method including the step of adjusting the tilt angles of the steam nozzles to desired setpoint values.

13. A method according to claim 12 which includes the step of monitoring and adjusting the pressure of steam exiting through the steam nozzles to desired setpoint values.

14. A method according to claim 12 which includes the step of monitoring and adjusting the height of the steam manifolds above the floor to at least one desired setpoint value.

15. A method according to claim 11 which includes step of monitoring and adjusting the minimum cross sectional area of the tunnel to a desired setpoint value.

16. A method according to claim 11 which include the step of monitoring and adjusting the temperature of the expanded tobacco to a desired setpoint value.

* * * * *